United States Patent [19]

Knowlton

[11] 4,317,246

[45] Mar. 2, 1982

[54] SURFACE CLEANING MACHINE

[75] Inventor: Christopher M. Knowlton, Toledo, Ohio

[73] Assignee: The Scott & Fetzer Company, Lakewood, Ohio

[21] Appl. No.: 180,090

[22] Filed: Aug. 21, 1980

[51] Int. Cl.[3] ..... E01H 1/04

[52] U.S. Cl. ..... 15/83; 15/340; 56/344; 100/233; 414/525 R

[58] Field of Search ..... 15/83-86, 15/340; 100/233; 414/525 R; 56/202, 344

[56] References Cited

U.S. PATENT DOCUMENTS

| | | | |
|---|---|---|---|
| 819,178 | 5/1906 | Sheley | 15/83 |
| 2,046,679 | 7/1936 | Furstnow | 15/83 |
| 2,789,067 | 4/1957 | Link, Jr. | 15/83 X |
| 3,093,853 | 6/1963 | Tamny | 15/83 |
| 3,369,685 | 2/1968 | Price et al. | 15/84 |
| 3,665,545 | 5/1972 | Beekman | 15/340 |
| 4,170,934 | 10/1979 | Oosterling et al. | 100/233 |
| 4,271,756 | 6/1981 | Bettencourt | 100/233 |

*Primary Examiner*—Edward L. Roberts
*Attorney, Agent, or Firm*—Allen D. Gutchess, Jr.

[57] ABSTRACT

A sweeping machine with a hopper forming a compactor flap or plate is provided. The hopper has an opening which receives dirt and debris swept from a surface being cleaned by a rotatable brush of the sweeping machine. The compactor flap is pivotally mounted in the hopper and has an outer edge positioned close to an edge of the hopper opening when in a first position. The outer edge of the flap is spaced farther from the hopper opening and toward an end wall of the hopper when in a second position. The compactor flap is pivoted from the first position to the second position periodically to move dirt and debris away from the hopper opening and to compact it against the hopper end wall. The hopper also has a movable lip adjacent the lower edge of the opening. A flexible strip extends across the hopper and has an upper edge connected to the edge of the bottom wall of the hopper defining the lower edge of the opening. The flexible strip has an intermediate portion connected to an edge of the movable lip and the strip has a lower edge which contacts the surface to be cleaned. The movable lip can be counterweighted so as to pivot upwardly when the hopper is passing over larger debris and otherwise is closer to the surface to be cleaned to prevent dirt being swept by the rotatable brush from escaping under the hopper.

20 Claims, 6 Drawing Figures

SURFACE CLEANING MACHINE

This invention relates to a floor-sweeping machine with a hopper having a compactor flap therein for compacting debris therein.

A sweeper embodying the invention ordinarily is of the riding type and employs a rotatable drum brush at an intermediate point under the machine with a driver's position being located at the rear of the machine. A hopper is located toward the front of the machine with a rear opening located near the drum brush to receive dirt and debris therefrom. The hopper has a bottom wall, two side walls, and an upper wall defining the hopper opening and an end wall spaced forwardly to define a debris and dirt-receiving chamber.

A compactor flap is pivotally mounted in the chamber, preferably near the bottom wall thereof. The compactor flap has an outer edge positioned close to an edge of the hopper opening when in a first position. The outer edge of the compactor flap is spaced farther from the opening and closer to the end wall of the hopper when in a second position. The compactor flap is then pivoted from the first position to the second position periodically to move dirt and debris away from the hopper opening and to compact it against the end wall. In this manner, particularly with larger, compactable debris, the hopper capacity can be substantially increased. Thus, fewer trips need be made to the location where the hopper is emptied, reducing fuel requirements and saving operator's time. The compactor flap can be pivoted between the positions by a fluid-operated ram mounted on the sweeper outside the hopper and having a piston rod connected to a lever arm which is affixed to a pivot shaft of the compactor flap.

The hopper also has a movable or pivotable lip located near the lower edge of the hopper opening. The movable lip is preferably counterweighted so as to easily pivot up and down. In this manner, the lip can be pushed up by larger debris over which the hopper passes and can then swing down again to catch the dirt and debris being swept by the rotatable drum brush. The movable lip has a unique construction in that a flexible strip extends across the lower edge of the hopper opening and has an upper edge connected to the edge of the bottom wall of the hopper defining the lower edge of the opening. The flexible strip also has an intermediate portion connected to the free edge of the movable lip. Further, the flexible strip extends below the movable lip and has a lower edge in contact with the surface to be cleaned. With this arrangement, dirt and debris cannot be collected between the movable lip and the bottom wall of the hopper and cause jamming.

It is, therefore, a principal object of the invention to provide a surface cleaning machine having a hopper with a compactor flap therein.

Another object of the invention is to provide a sweeper for cleaning large areas having a hopper capable of holding a larger amount of dirt and debris.

Yet another object of the invention is to provide a sweeper having a hopper with a lower movable lip with a flexible strip connected between the lip and the bottom wall of the hopper.

Many other objects and advantages of the invention will be apparent from the following detailed description of a preferred embodiment thereof, reference being made to the accompanying drawings, in which.

Figure 1:
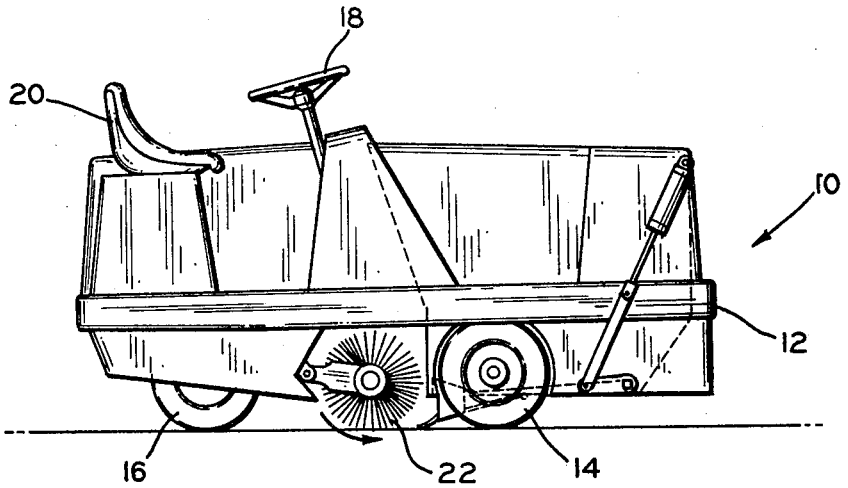
FIG. 1 is a somewhat schematic side view in elevation of a sweeping machine embodying the invention.

Referring particularly to FIG. 1, a riding sweeping machine embodying the invention is indicated at 10. The machine includes a main frame or body 12 with intermediate wheels 14, and a central, rear wheel 16 which is steered by a steering wheel 18 located in front of an operator's seat 20. Side brooms (not shown) can be located in front of the wheels 14, if desired, and a rotatable drum brush or broom 22 is located to the rear of the wheels 14.

A hopper 24 is positioned near the rotatable brush 22 to receive dirt and debris therefrom. The hopper 24 includes a bottom wall 26, an upper wall 28, and side walls 30 which define a dirt and debris-receiving opening 32. The hopper also includes an end wall 34 comprising a slanted lower portion 36 and a vertical upper portion 38 which define a dirt and debris-receiving chamber 40 along with the side walls, bottom wall, and upper wall. A vacuum chamber 42 is formed by the side walls 30, an end wall 44, a top 46, and a filter frame 48. A suitable filter 50 is located on the frame 48 and removes air-borne dirt from air drawn through the opening 32, the dirt and debris-receiving chamber 40, and the vacuum chamber 42 by a suitable exhaust blower 52. When the filter 50 is shaken, dirt falls onto the upper surface of the upper wall 28. When the hopper 24 is tilted in a counter-clockwise direction, as viewed in FIG. 2, dirt and debris are emptied through the opening 32 and filter dirt is emptied through a slot 54 thereabove.

A compactor flap or member 56 is located in the chamber 40 and includes a main plate 58 and a backing plate 60 which are affixed to a pivot shaft 62. The main plate 58 has an upturned outer or free edge portion 64 (FIG. 2) which nests with a ridge 66 formed on the bottom wall 26 between the edge portion 64 and the lower edge of the opening 32.

The ends of the shaft 62 are rotatably supported in bearings 68 (FIG. 3) in the side walls 30 and a square shaft 70 is affixed to one end of the shaft 62. A lever arm 72 (FIGS. 2–4) is affixed to the square shaft 70 and is pivotally connected by a pin 78 to a clevis 80. The clevis 80, in turn, is affixed to an end of a piston rod 82 which extends from a cylinder 84 of a fluid-operated ram 86.

Figure 2:
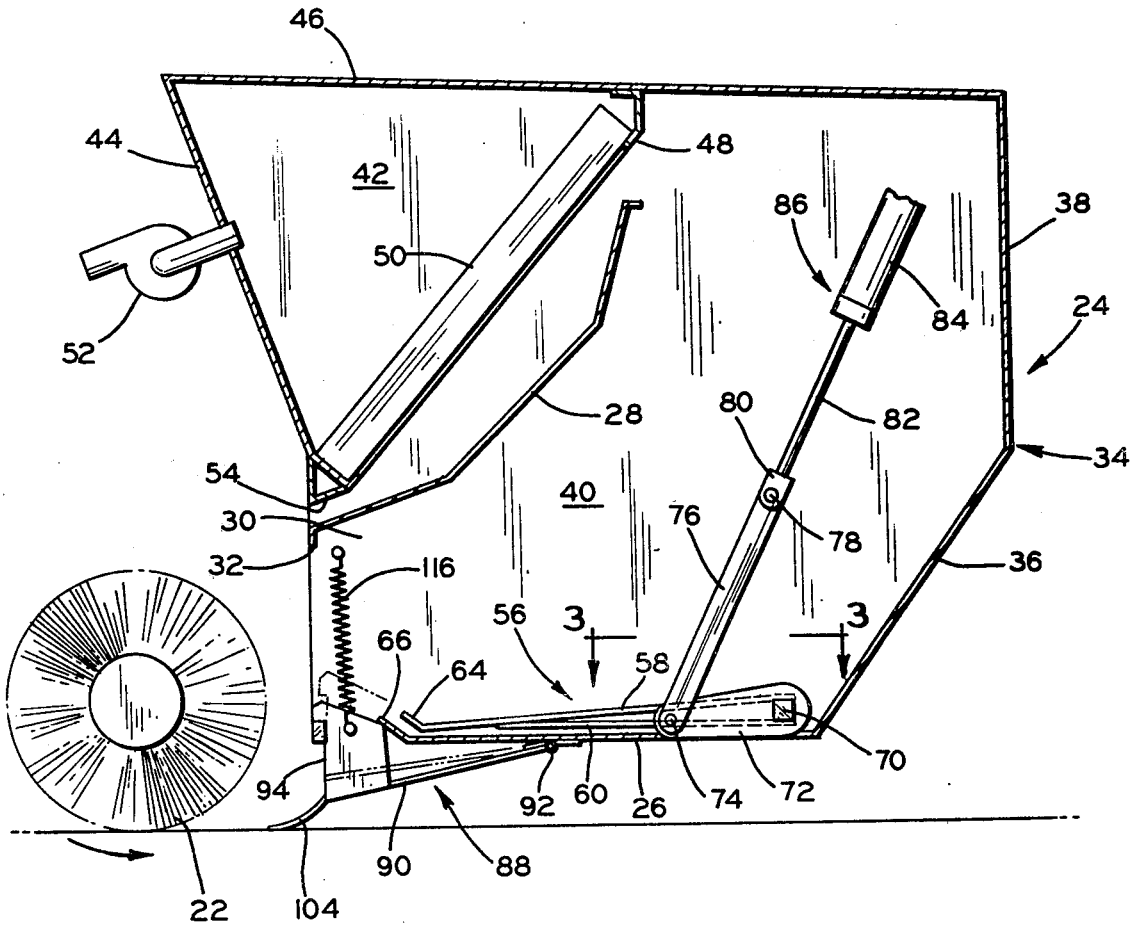
FIG. 2 is an enlarged side view in elevation of a drum brush and a hopper, with a side wall removed, of the sweeping machine.
Figure 3:
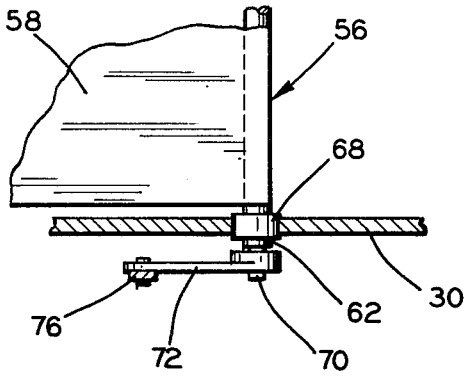
FIG. 3 is a fragmentary plan view of a portion of a compactor flap of the hopper, taken along the line 3—3 of FIG. 2.
Figure 4:
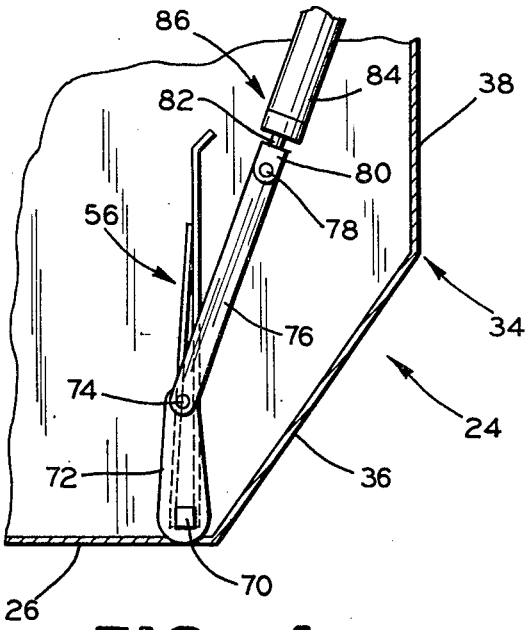
FIG. 4 is a fragmentary view in elevation of the hopper of FIG. 2, with the compactor flap shown in a different position.

The compactor flap 56 is movable between positions shown in FIGS. 2 and 4. In the lower position of FIG. 2, dirt and debris in the chamber 40 are collected on top of the flap 56. The nesting relationship of the upturned edge portion 64 of the flap and the ridge 66 of the bottom wall 26 minimizes the chance for dirt or debris from collecting between the flap and the bottom wall. When the flap 56 is moved by the ram 86 to an upper position, as shown in FIG. 4, the dirt and debris on the flap are moved back toward the end wall 34 and the debris is compacted between the end wall and the flap, especially as the chamber 40 fills with dirt and debris. The flap 56 is then moved to the lower position of FIG. 2 again so that sweeping operations can continue. The flap 56 can be periodically operated and the operator knows the hopper chamber 40 is full when dirt begins to trail out both edges of the sweeper while the rotatable broom 22 continues to clean the center of the path. At this time, the sweeper can be driven to the dumping site or the flap 56 can be raised to the upper position once again and sweeping can continue until the trailing dirt occurs again. At that time, the sweeper can be taken to the dumping site and the hopper dumped, at which time the flap 56 is lowered again to the position of FIG. 2.

A movable or pivotable lip 88 is located generally below the opening 32 and includes a plate 90 which is affixed to a lower surface of the bottom wall 26 by a piano-type hinge 92. The plate 90 has side flanges 94 which close off the lower edges of the hopper sides adjacent the opening 32. The side flanges 90 can have shoulders 96 which cooperate with side stops 98 to limit downward movement of the lip 88.

Figure 5:
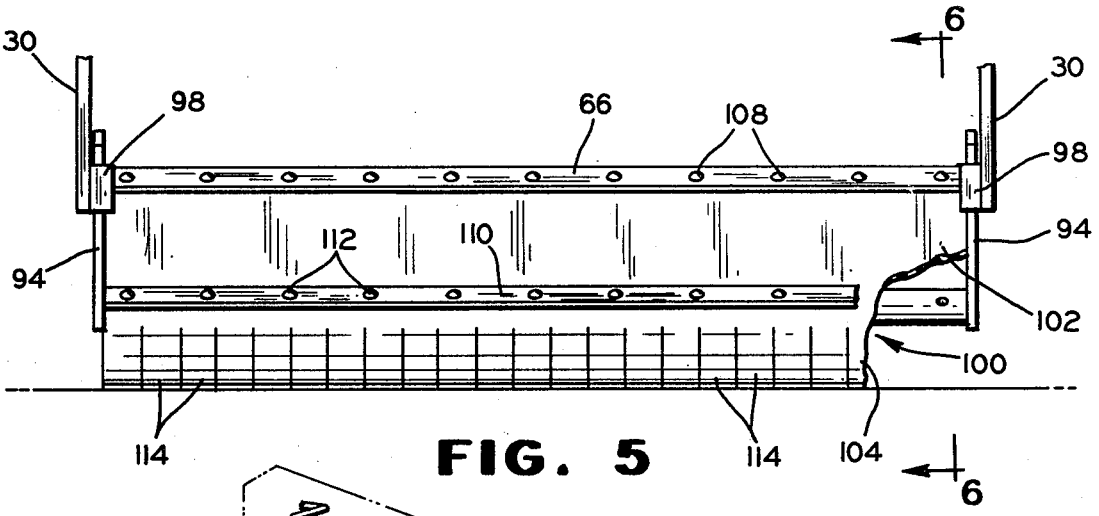
FIG. 5 is a fragmentary view in elevation of a pivotable lip of the hopper.
Figure 6:
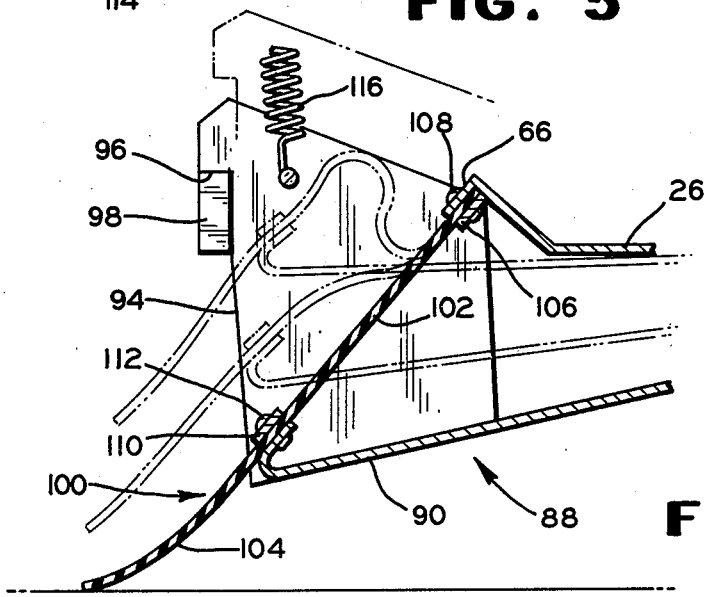
FIG. 6 is a further enlarged view in section, taken along the line of 6—6 of FIG. 5.

As shown in FIGS. 5 and 6, a flexible strip 100 extends across the hopper 24 below the opening 32. The flexible strip includes an upper bridging portion 102 and a lower depending portion 104 with the upper edge of the upper portion 102 affixed to an edge of the bottom wall 26 adjacent the ridge 66. This can be accomplished by any suitable means, such as a fastening strip 106 and rivets 108. An intermediate portion of the strip 100, at the lower edge of the upper portion 102, is affixed to the free edge of the lip plate 90 by suitable means, such as a fastening strip 110 and rivets 112. The lower portion 104 of the strip 100 is slit to form segments 114 which contact the surface to be cleaned. The pivotable lip 88 can be counterbalanced by suitable means such as by springs 116.

The lip 88 prevents dirt and debris from escaping under the hopper 24 with the upper portion 102 of the flexible strip 100 also preventing the debris from entering between the plate 90 and the bottom wall 26. At the same time, the strip can readily flex, as shown in dotted lines in FIG. 6, when the plate 90 is pushed up by debris over which the hopper 28 passes. The counterbalancing enables such debris to raise the lip 88 easily and the lip can swing down quickly after the debris is passed to prevent the debris from escaping under the hopper again when engaged by the broom 22.

Various modifications of the above described embodiment of the invention will be apparent to those skilled in the art, and it is to be understood that such modifications can be made without departing from the scope of the invention, if they are within the spirit and the tenor of the accompanying claims.

I claim:

1. A machine for sweeping surfaces comprising a frame, wheel means supporting the frame on the surface, a rotatable sweeping brush carried by said frame, a hopper carried by said frame near said sweeping brush, said hopper comprising a bottom wall, two side walls, an upper wall, and an end wall defining a dirt and debris receiving chamber, said bottom wall, said top wall and said side walls defining an opening through which dirt and debris are received from said rotatable brush, a compactor flap pivotally mounted in said hopper at a location spaced from said opening, said flap having one position in which an outer edge spaced from the pivot is adjacent said opening and another position in which said outer edge is closer to said end wall, and means for moving said compactor flap between the positions.

2. A machine according to claim 1 wherein said compactor flap is pivotally mounted on an axis parallel to one of said hopper walls and the outer edge of said flap is adjacent the same wall when said flap is in said one position.

3. A machine according to claim 2 wherein said one wall has a ridge adjacent the outer edge of said flap, between the outer edge and the hopper opening.

4. A machine according to claim 3 wherein said outer edge of said flap is turned up adjacent said ridge.

5. A machine according to claim 3 wherein said same wall is said bottom wall.

6. A machine according to claim 1 wherein said moving means comprises fluid-operated means located outside said hopper and mounted on said machine.

7. A machine according to claim 1 wherein said moving means comprises a shaft extending outwardly through one of said hopper walls, a lever arm affixed to said shaft outside said hopper, and means for pivoting said lever arm.

8. A machine according to claim 7 wherein said lever arm pivoting means comprises a fluid-operated cylinder mounted on said hopper.

9. A machine according to claim 1 wherein said bottom wall has a movable lip with an edge extending toward said rotatable brush and located adjacent said hopper opening.

10. A machine according to claim 9 wherein said movable lip has a flexible strip affixed to the edge thereof at an intermediate portion of said flexible strip, said strip extending substantially entirely acoss said bottom wall below said hopper opening, the upper edge of said flexible strip being affixed to the edge of the bottom wall of said hopper adjacent said opening.

11. A machine according to claim 10 wherein said flexible strip also extends downwardly below the edge of said movable lip and contacts the surface to be cleaned.

12. A machine for sweeping surfaces comprising a frame, wheel means supporting the frame on the surface, a rotatable sweeping brush carried by said frame, a hopper carried by said frame near said sweeping brush, said hopper comprising a bottom wall, two side walls, an upper wall, and an end wall defining a chamber for receiving dirt and debris, said bottom wall, said upper wall, and said side walls also defining an opening through which dirt and debris from said rotatable brush enters said chamber, and a lip adjacent the lower edge of said opening, said lip comprising a pivotable plate, a hinge affixed to said bottom wall and pivotally supporting said plate through an edge portion thereof, said plate having a free edge spaced from said hinge, and a flexible strip extending across said hopper opening, said flexible strip having a bridging portion extending between said bottom wall and said pivotable plate, an intermediate portion of said strip being affixed to said free edge of said plate, and said strip also having a depending portion extending downwardly below said pivotable plate.

13. A machine according to claim 12 wherein said bridging portion of said strip has an upper edge affixed to said bottom wall.

14. A machine according to claim 13 wherein said upper edge of said strip is affixed to the edge of said bottom wall adjacent said opening.

15. A machine according to claim 12 wherein said depending portion of said strip extending below said pivotable plate has slits to form vertical segments.

16. A machine according to claim 12 wherein said bridging portion of said flexible strip between said bottom wall and said pivotable plate extends outwardly away from said opening.

17. A machine according to claim 12 wherein a compactor member is movably mounted in said hopper for compacting debris therein.

18. A machine according to claim 17 wherein means are mounted on the outside of said hopper for moving said compactor member.

19. A machine according to claim 12 wherein a compactor member is pivotally mounted in said hopper on an axis parallel to one of said hopper walls and the outer edge of said member is adjacent the same wall when said member is in one position.

20. A machine according to claim 19 wherein means are mounted on the outside of said hopper for moving said compactor member between the one position adjacent said one wall and a position wherein said member is closer to said end wall.

* * * * *